US005855041A

United States Patent [19]

McMichael

[11] Patent Number: 5,855,041

[45] Date of Patent: Jan. 5, 1999

[54] SLIDING PANEL ANTI-FRICTION RUNNER

[76] Inventor: Paul C. McMichael, 15 Hawthorne Dr., Berryville, Va. 22611

[21] Appl. No.: 628,514

[22] Filed: Apr. 5, 1996

[51] Int. Cl.[6] ..... A47H 15/00; E05D 15/06

[52] U.S. Cl. ..... 16/91

[58] Field of Search ..... 16/90, 91, 106, 16/99, 100.97, 98, 107, 29, 40; 49/425–427, 452, 404; 105/339, 355, 378, 377.09, 404; 464/184; 160/326; 410/67; 296/155; 193/35 C, 37

[56] References Cited

U.S. PATENT DOCUMENTS

| | | | |
|---|---|---|---|
| 2,145,403 | 1/1939 | Nemec | 16/91 |
| 2,800,679 | 7/1957 | Schultz, Jr. | 16/40 |
| 2,900,679 | 8/1959 | Migneault et al. | 16/91 |
| 3,030,654 | 4/1962 | Migneault et al. | 16/91 |
| 3,204,285 | 9/1965 | Butsch | 16/40 |
| 3,703,020 | 11/1972 | Skupas et al. | 16/40 |
| 5,586,803 | 12/1996 | Overpeck | 16/40 |

*Primary Examiner*—Chuck Mah
*Assistant Examiner*—Doanld M. Gurley
*Attorney, Agent, or Firm*—J. Gibson Semmes

[57] ABSTRACT

This heavy-duty, sliding panel door guard/bumper includes a rigid base plate which is suitable for mounting upon a doorjamb or a sliding panel in a distortion-free connection, by means of plural fastening anchors. The panel serves as a mount for opposed trunnions which mount a wheel axle thereon. The gudgeons of the trunnions are elevated vertically from the base plate, adjacent one end thereof and the elevation of each trunnion is inclined forwardly to form a sliding slope which corresponds at its proximal end to the circumference of an aligned sliding panel bumper wheel, although the maximum elevation of the trunnions is less than the protruding circumference of the bumper wheel. The wheel has axle bearings therein such that a minimum of friction is presented to passing contact of one heavy duty panel which is slid relative to another. Guard/bumpers are incorporated in large and small sizes when adapted to door panels which are slided relative to each other, the small sizes being positioned for ease of by-pass movement of panels, relative to each other. The door guard/bumper may be variously mounted upon a doorjamb, or upon one of sliding panels which is opposite another. Complementary plural guards may thus be mounted.

4 Claims, 4 Drawing Sheets

SLIDING PANEL ANTI-FRICTION RUNNER

BACKGROUND OF THE INVENTION

The present Sliding Panel Anti-Friction Runner invention has been developed, applied and proven to permit large, heavy doors hung on a track and trolley system to be moved reciprocally with greatest ease. It is adaptable to various sizes of doors and has numerous separate uses. For example: In its principal function, it prevents sliding doors from rubbing the jamb, building and/or against other doors in by-pass functions. As a sliding door may hang from a track above, the invention serves as an adjustable stay roller guide. In the prior art, related stays are applied to the bottom of the door to ensure that the door bottom may not exceed a desired distance in extension of the building. Nonetheless, until the present there has been provided no means available for maintaining a desired clearance between the door and building, despite buckling or warping. In addition to the conventional bottom roller guide, the invention maintains a desired clearance between a sliding door and building. In by-pass door environments, a combination of runners maintains a desired clearance between doors which slide relative to each other. The invention is proven especially helpful with heavy wooden doors that have a tendency to move, by means of expanding and contracting, swelling, bowing, etc., wherein conditions such as temperatures and humidity, affect wood products designed for exterior use.

This heavy-duty, sliding panel door guard/bumper includes a rigid base plate which is suitable for mounting upon the sliding panel in a distortion-free connection, by means of plural anchors. The panel serves as a mount for plural journals which mount an axle thereon. The journals are elevated vertically from the base plate, adjacent one end thereof and the elevation of each journal is graduated rearwardly to form a sliding slope which corresponds at the distal end with the circumference of one or more aligned sliding panel bumper wheel, although the maximum elevation of the journals is less than the protruding circumference of the bumper wheel. The wheel has axle bearings therein such that a minimum of friction is presented to passing contact of one heavy duty panel which is slid relative to another. The door guard/bumper may be variously mounted upon a doorjamb, upon opposed doorjambs, or upon one of sliding panels which is opposite another. Plural guards may thus be mounted. Likewise, utility may be enhanced by mounting large and small-sized guards as will appear below.

DESCRIPTION OF THE PRIOR ART

| INVENTOR | DATE | PAT. NO. | DESCRIPTION |
|---|---|---|---|
| Mattoon | 1884 | 307,131 | Stay Roller for Sliding Doors |
| Wideman | 1907 | 873,816 | Stay Roller |
| Klotz | 1911 | 988,880 | Roller for Sliding Doors |
| Heise | 1915 | 1,123,287 | Stay Roller for Sliding Doors |
| Riley | 1950 | 2,527,032 | Sash Holder |
| Trammel, Sr., et al. | 1954 | 2,676,367 | Window Unit |
| Migneault et al. | 1962 | 3,030,654 | Pressure Applying Device |
| Stevenson | 1987 | 4,672,712 | Wind Restraining Stay Roller |
| Peterson et al. | 1988 | 4,723,374 | Cantilevered Sliding Gate |
| Gibbs et al. | 1992 | 5,136,813 | Cantilever-Type Sliding Gate |

The invention is especially useful in holding heavy sliding doors, in normal hanging disposition, relative to the side of a barn. It is also adapted to sliding opposed doors back and forth, viz: when elemental forces create a "sail" effect, encountered in heavy winds. Nonetheless, the invention mount is primarily adapted to be fixed to the jamb or sill of the barn construction and its contact with the moving door is such as to alleviate friction between the sliding door and its support such as structural elements of the building itself.

DESCRIPTION OF THE PREFERRED EMBODIMENTS

Figure 1:
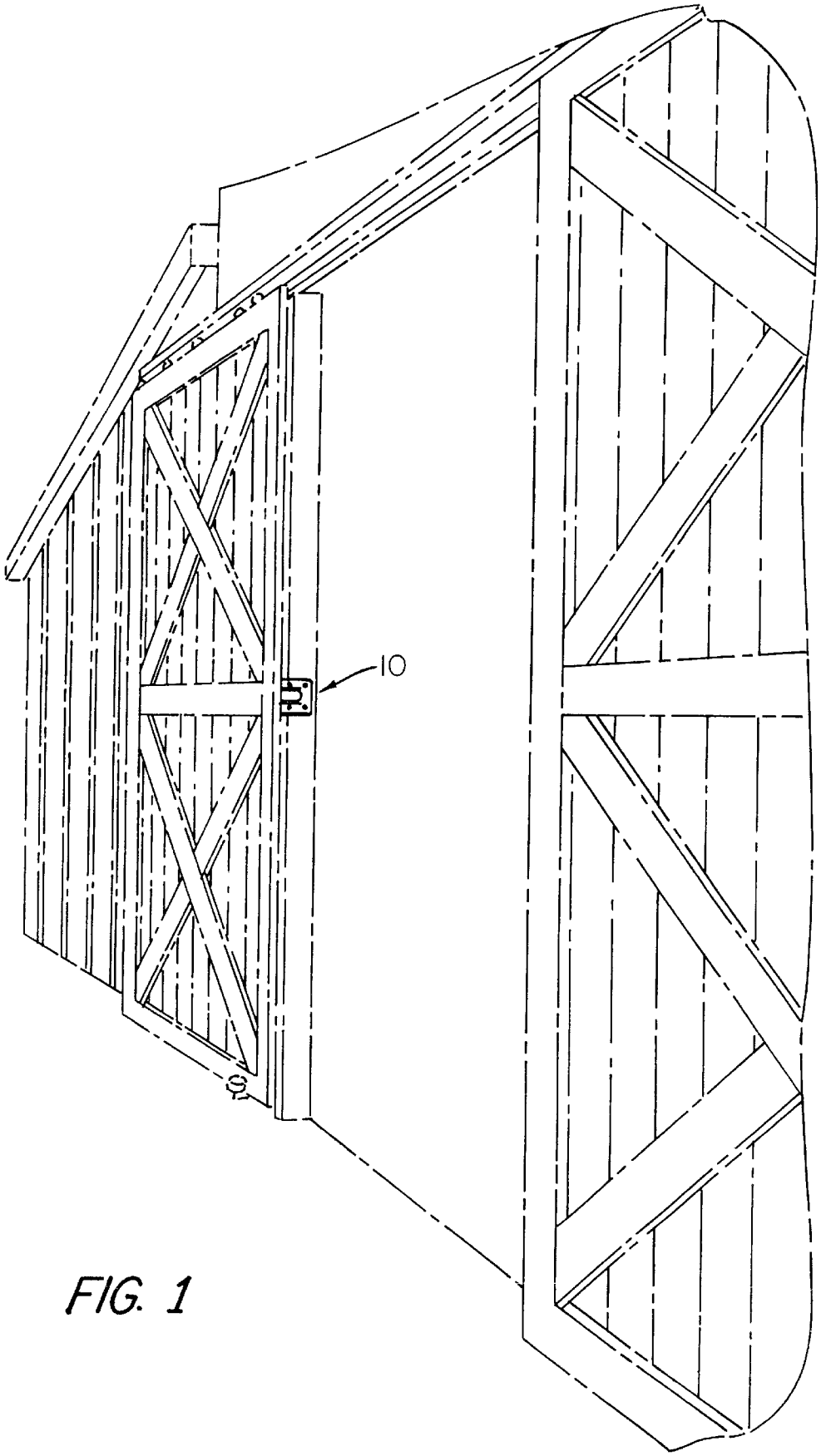
FIG. 1 is a view in perspective of the invention, mounted upon a support element of a building construction. The sliding door is mounted upon track rollers and is restrained at the bottom by a conventional stay roller.
Figure 2:
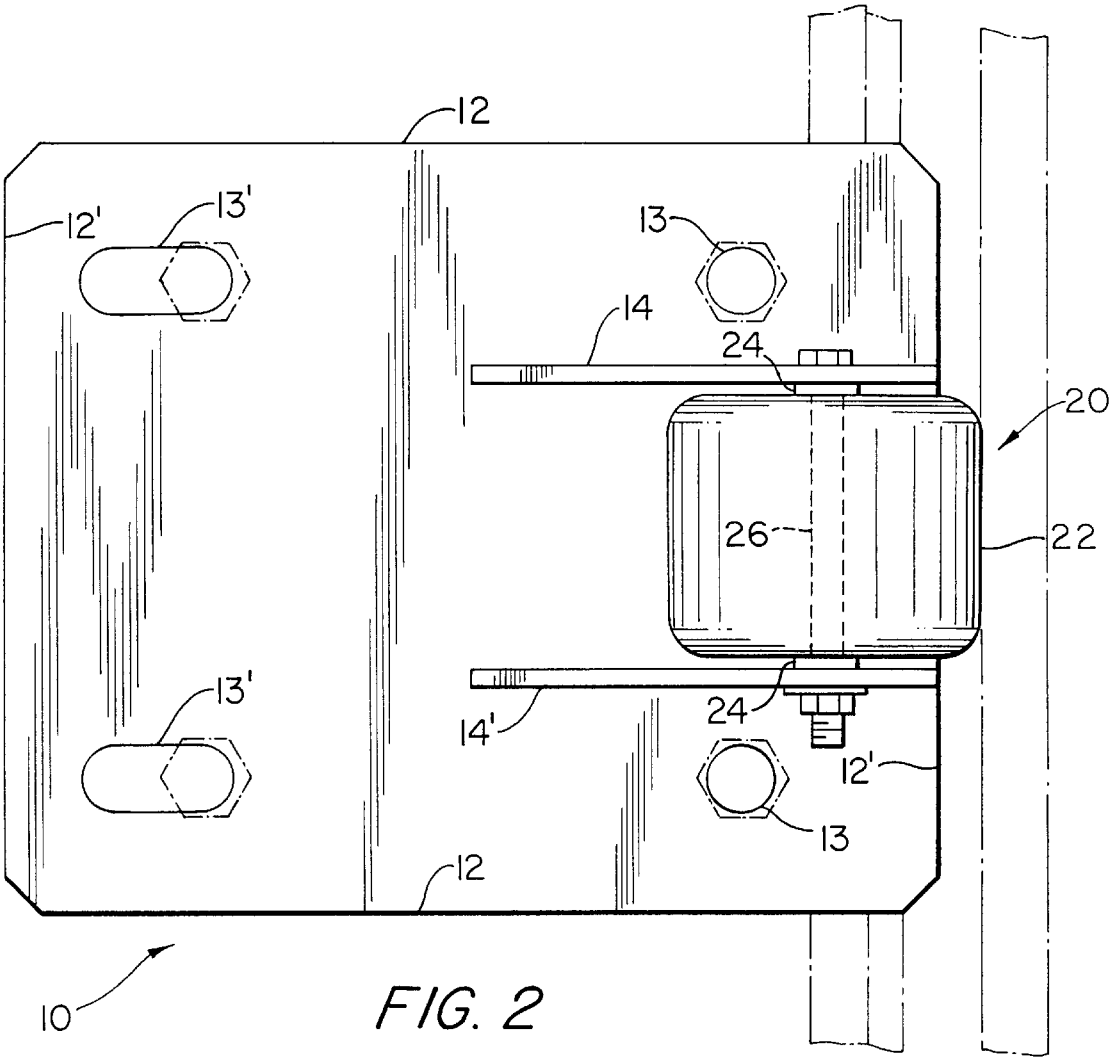
FIG. 2 is a view in top plan of the invention depicted in FIG. 1, above.
Figure 3:
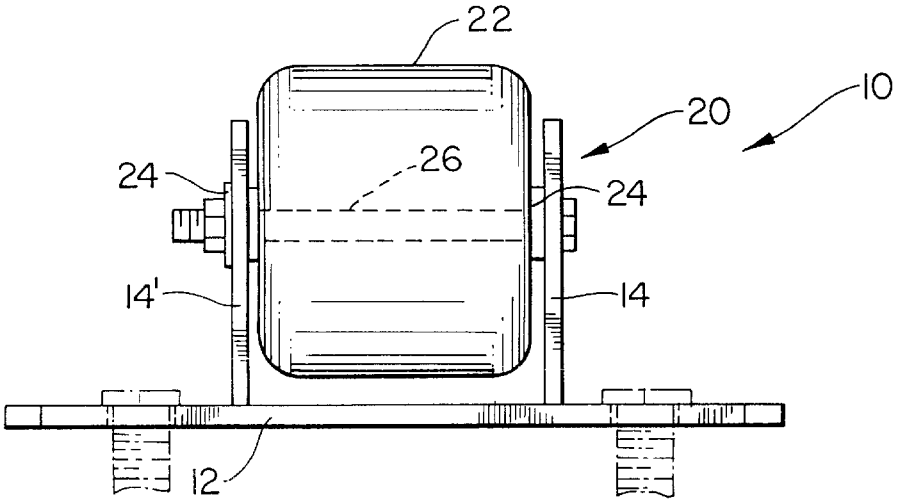
FIG. 3 is a view in front elevation of the invention depicted in FIGS. 1 and 2, above.
Figure 4:
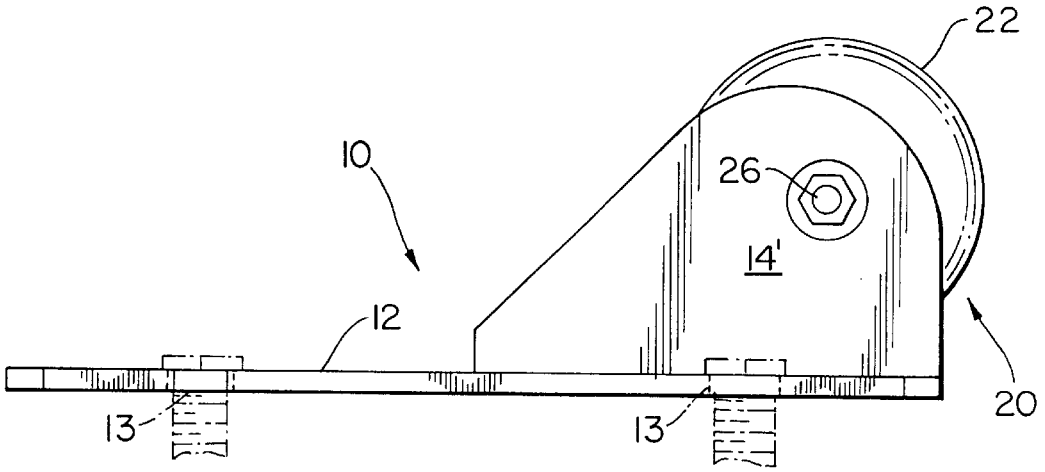
FIG. 4 is a view in side elevation of the invention depicted in FIGS. 1, 2 and 3, above.

Referring to the drawings, the sliding panel anti-friction runner 10 is broadly depicted in FIGS. 1, 2 and 3 wherein the assembly is shown to have an elongate dimension and a transverse dimension such as to provide an anchor base 12–12' upon which opposed mirror image trunnions 14–14' are mounted in fixed, spaced-apart relation to each other. These upright trunnions are adapted to provide coactive axle gudgeons 15–15'. The trunnions are sloped, rear to front, such as to provide a slide for preliminary engagement by a sliding panel or door. The base 12–12' may be apertured as indicated in the side elevation of FIG. 4, the forwardmost anchor fastening means 13–13' being especially set rearward of apertures of the gudgeons 15–15' in the forward position and preferably longitudinally aligned with the apertures in the anchor base rearwardly thereof, such that upon mounting of the roller wheel, there is established reinforcing triangulation, corner to corner for stability against dislodging forces as explained hereinafter.

Mounted within the confines of the trunnions 14–14' is a roller bearing wheel and axle assembly 20 defining therein bearings. The runner wheel 22 being mounted on axle 26, has bearing free compressive contact with the gudgeons 15–15'. For this purpose, trunnion spacers 24 are provided at the hub of the runner wheel 22 as shown in FIGS. 2 and 3.

For attachment of the unit 10 to a post and frame building, reference is made to FIGS. 1 and 2. In FIG. 7, the assembly 10 shown is fixed to a post of a frame building, said post providing a sliding door jamb. As indicated previously, the preferred utility of the sliding door assembly is evident when the sliding door is applied to a track and trolley system, the effect of the invention being to maintain a spatial relationship between the sliding panel and jamb by means of the anti-friction runner 10 applied to a fixed supporting element of the building, per se. As to FIG. 6, a similar relationship is shown, nonetheless one or more of the anti-friction runner assemblies is applied to door panels which may move relative to each other and/or the building upon which they are track and trolley mounted.

Figure 5:
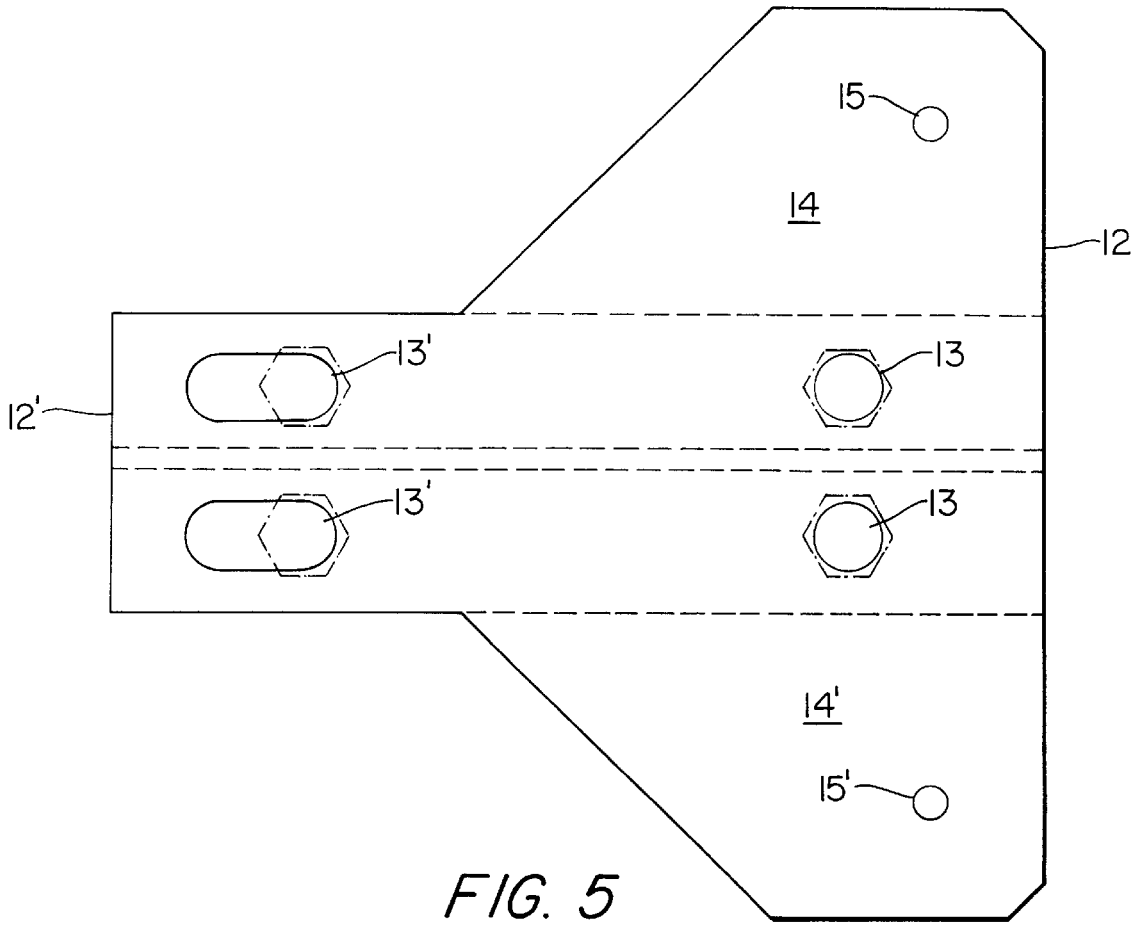
FIG. 5 is a view in top plan, a modification of the invention, depicting its anchor base as one of successive strips, precedent to its trunnions being folded.

According to the invention, a built-in reinforcement of the plate 12–12', against distortional forces is inherent in the plate construction by virtue of the locus of the anchor receptacle apertures 13–13' and anchor fasteners relative to the axis of the wheel and axle assembly. Extending the imaginary axis line of axle 26 beyond the trunnions on each side of the center axis of the plate causes that axis line to intersect imaginary extension lines drawn through centers of diametrically opposite apertures 13–13'; these latter lines define the hypotenuse of each triangle. Thus, with reference to top plan FIGS. 2 and 5 force-lines between diametrically opposed forward and rearward receptacle apertures create overlapping right-angle triangles so that when fasteners compressibly secure the unit 10 to a supporting surface, a reinforcing effect against runner distortion is applied to plate 12–12'. This desired effect is even more pronounced in the utility of the stamped sheet metal configuration shown in FIGS. 5 and 8.

Figure 8:
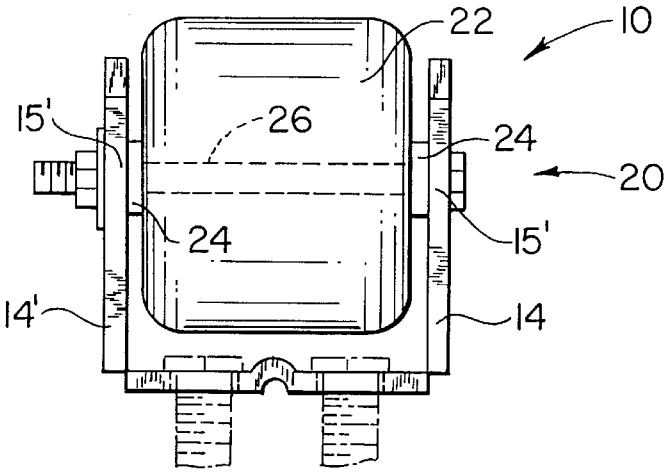
FIG. 8 depicts in front elevation, the modification of FIG. 5.

In the FIG. 8 modification of plate 12–12', like elements are identified similarly to corresponding elements of the configuration of FIGS. 1–4. The essential difference, aside from the type of materials used, comprises in the FIGS. 5 and 8 configuration an end-to-end reinforcing rib formed concurrently with stamping of the plate 12–12'. The foldability of the trunnions 14–14' will be apparent as will the formation of opposed anchoring apertures 13–13'. The FIGS. 5 and 8 modification therefore lends itself to assembly-line stamping technique.

Figure 6:
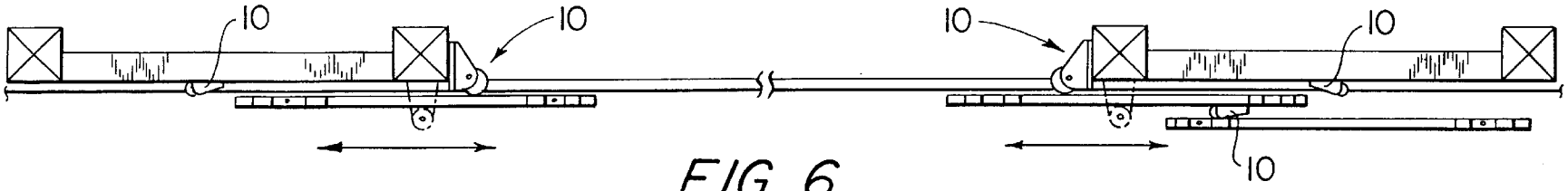
FIG. 6 is a top plan view of invention as applied to the fixed building construction and to coactively related by-pass sliding door construction.
Figure 7:
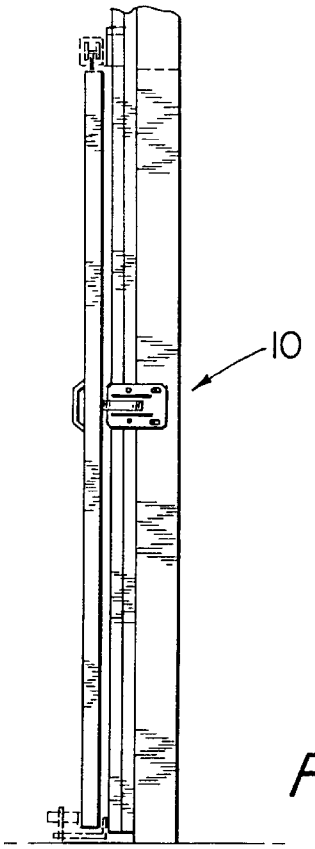
FIG. 7 depicts in side elevation the unit of FIG. 1.

The plan view, right-hand portion of FIG. 6 depicts the multiple function of combined large and small anti-friction runners. The smaller runners 10' coact to definitively place by-passing panels relative to each other.

Many modifications and variations of this invention are possible in light of the above teachings. I therefore intend the above terminology to illustratively describe the invention's preferred embodiment and not to limit its scope. Within the scope of the appended claims, in which reference numerals are merely for convenience and are not limiting, one may practice the invention other than as the above specification describes.

The scope of invention is thus defined in the following claims.

I claim:

1. In combination with a heavy duty sliding panel anti-friction runner (10) fabricated of stamped sheet metal wherein:

a) an elongated anchor base (12–12') said base defining front and rear pairs of spaced apart fastening base apertures (13–13'), said base further defining opposed wings adjacent a forward end, respective wings being foldable into opposed upright positions to form spaced-apart trunnions, the trunnions defining axially aligned gudgeons (15–15'), b) a roller bearing wheel and axle assembly (20) including a wheel (22), said wheel being mounted upon an axle the axle (26), the axle being set within the gudgeons (15–15') of the trunnions (14–14') whereby a portion of the periphery of the wheel (22) extend beyond a forward edge of the anchor's base (12–12').

2. The sliding panel anti-friction runner of claim 1 wherein the trunnions (14–14') are inclined from rear to apex thereof.

3. The anti-friction runner of claim 1 wherein the two pairs of fastening apertures are arranged in a rectangular configuration.

4. In combination with a heavy duty sliding panel, an anti-friction runner (10) fabricated of stamped sheet metal wherein:

a) an elongated anchor base (12–12') is formed, said base defining wings adjacent a forward end, respective wings being foldable into opposed upright positions to form spaced-apart trunnions (14–14'), the trunnions defining axially aligned gudgeons (15–15'), said trunnions being inclined from rear to apex thereof;

b) a roller bearing wheel and axle assembly (20) including a wheel (22), said wheel being mounted upon an axle (26), which is set within the gudgeons (15–15'), whereby a portion of the periphery of the roller wheel (22) extends beyond a forward edge of the anchor base (12–12');

c) the anchor base comprised a front and rear pair of fastening means arranged in a rectangular configuration and wherein one of the pairs defines a slot.

* * * * *